US005271503A

United States Patent [19]

Lindström

[11] Patent Number: 5,271,503

[45] Date of Patent: Dec. 21, 1993

[54] SCREENING DEVICE

[75] Inventor: Alf I. Lindström, Sundsbruk, Sweden

[73] Assignee: Sunds Defibrator Industries Aktiebolag, Sweden

[21] Appl. No.: 938,214

[22] PCT Filed: Apr. 25, 1991

[86] PCT No.: PCT/SE91/00268

§ 371 Date: Oct. 13, 1992

§ 102(e) Date: Oct. 13, 1992

[87] PCT Pub. No.: WO91/19043

PCT Pub. Date: Dec. 12, 1991

[30] Foreign Application Priority Data

May 25, 1990 [SE] Sweden ..... 9001881

[51] Int. Cl.[5] ..... B07B 1/04

[52] U.S. Cl. ..... 209/273; 209/303; 209/306

[58] Field of Search ..... 209/303, 664, 667, 683, 209/690, 211, 385, 389, 390, 406, 270, 273, 306

[56] References Cited

U.S. PATENT DOCUMENTS

| | | | |
|---|---|---|---|
| 3,400,820 | 9/1968 | Nelson | 209/273 |
| 3,452,875 | 7/1969 | Rich et al. | 209/270 X |
| 3,677,402 | 7/1972 | Holz | 209/270 |
| 4,287,055 | 9/1981 | Holz | 209/306 X |
| 4,749,474 | 6/1988 | Young | 209/273 |
| 4,836,915 | 6/1989 | Frejborg | 209/273 |

*Primary Examiner*—D. Glenn Dayoan

*Attorney, Agent, or Firm*—Lerner, David, Littenberg, Krumholz & Mentlik

[57] ABSTRACT

A device for screening pulp suspensions includes a cylindric housing (1) with inject inlet (2), reject outlet (3) and accept outlet (4) and screening members in the form of a stator (5) and a rotor (8). The stator (5) as well as the rotor (8) include a plurality of annular elements (6 and 9, respectively), which are arranged in a mutual spaced relationship. The rotor (8) is located radially outside the stator (5), so that the rotor elements (9) are located directly in front of the spaces between the stator elements (6), and the axial length of the rotor elements is greater than the spaces between the stator elements. Thereby gaps (11) are formed between the stator elements and rotor elements.

10 Claims, 3 Drawing Sheets

SCREENING DEVICE

FIELD OF THE INVENTION

The present invention is directed to apparatus for separating impurities, such as coarse particles (e.g., knots and other undefibered materials) from pulp suspensions. More particularly, the present invention is directed to such apparatus for screening through gaps in which the surfaces defining those gaps are relatively movable with respect to each other.

BACKGROUND OF THE INVENTION

The types of screens which are designed for screening through gaps in which the surfaces defining the gaps are relatively movable with respect to each other, or so-called gap-screens, are usually designed so as to have a cylindrical housing with an inlet for the injected pulp suspensions and outlets for both the reject and accept portions of the pulp suspensions, respectively. Within these housings, a stator and a rotor are generally located, which between them define one or more gaps through which the pulp suspension is intended to pass. In this manner, coarse material, which cannot pass through the gaps, is separated from the pulp suspensions in the form of a reject.

A gap-screen comprising several gaps can be formed with concentric rings, every second one of which is stationary and thus alternates with rotary such rings. The gaps are then located at alternating spaces with respect to the center of rotation. This, in turn, implies that the flow conditions are different at the different gaps. Furthermore, the number of gaps is restricted by the fact that the diameter of the screen must be limited by factors such as the circumferential speed thereof.

If, instead, the gaps were located radially, i.e., the rings defining the gaps were located sequentially in the axial direction, the diameter of the screen can be limited even with a larger number of such gaps. Problems arise, however, with the mounting and dismounting of the rings defining the gaps, because these rings must be mounted and dismounted individually and sequentially, which becomes both complicated and tedious. At the same time, it is difficult to maintain a definite gap width, because an improper dimension of one ring can affect the size of all of the gaps.

SUMMARY OF THE INVENTION

In accordance with the present invention, the aforesaid problems are solved, and at the same time additional advantages in the screening of pulp suspensions are achieved. In accordance with this invention, the stator and the rotor comprise a plurality of annular elements arranged in a mutually spaced relationship. The rotor is thus located radially outside the stator, so that the rotor elements are located directly in front of the spaces between the stator elements, and the axial length of the rotor elements is greater than the spaces between the stator elements and the rotor elements. In view of this design, the stator and the rotor can be mounted and dismounted as separate units. Furthermore, a definite gap width can be obtained for all of the gaps, since it can be defined by the radial distance between the annular elements of both the stator and the rotor.

In accordance with the present invention, apparatus is provided for screening a pulp suspension comprising a housing including an inlet for the pulp suspension, screening means for screening the pulp suspension, a reject outlet for removal of a portion of the pulp suspension which does not pass through the screening means, and an accept outlet for removal of a portion of the pulp suspension which does pass through the screening means, the screening means comprising a stator rigidly mounted within that housing, and a rotor rotatably mounted within the housing radially outward from the stator, the stator including a plurality of annular stator elements axially spaced along the stator whereby the plurality of stator elements alternate with a plurality of stator spaces therebetween, and the rotor including a plurality of annular rotor elements axially spaced along the rotor, whereby the plurality of rotor elements alternate with a plurality of rotor spaces therebetween, the plurality of rotor elements being axially spaced at locations corresponding to the plurality of stator spaces, thereby forming axial gaps between the plurality of stator elements and the plurality of rotor elements.

In accordance with one embodiment of the apparatus of present invention, the plurality of stator spaces each comprises a predetermined axial stator space length. Preferably, the plurality of rotor elements each comprises a predetermined axial rotor element length, and the predetermined axial rotor element length is greater than the predetermined axial stator space length, whereby the plurality of rotor element overlaps the plurality of stator spaces.

In accordance with another embodiment of the apparatus of the present invention, the plurality of annular stator elements includes an outer surface, and the plurality of annular rotor elements includes an inner surface, and both the outer surface of the plurality of annular stator elements and the inner surface of the plurality of annular rotary elements are cylindrical. In another embodiment, however, both the outer surface of the plurality of annular stator elements and the inner surface of the plurality of annular rotor elements are conical.

In accordance with another embodiment of the apparatus of the present invention, the stator includes a plurality of axially extending holding means for mounting the plurality of annular stator elements. In another embodiment, the rotor includes a plurality of axially extending rotor holding means for mounting the plurality of axial rotor elements. In a preferred embodiment, the rotor includes axially extending perforated plate means for mounting the plurality of annular rotor elements.

In accordance with a preferred embodiment of the apparatus of the present invention, the apparatus includes cleaning means mounted on at least one of the plurality of annular stator elements and extending into at least one of the corresponding plurality of rotor spaces. In a preferred embodiment, the cleaning means comprises a plurality of cleaning elements mounted on the plurality of annular stator elements and extending into the corresponding plurality of rotor spaces.

BRIEF DESCRIPTION OF THE DRAWINGS

The following detailed description can be more fully appreciated with reference to the Figures, in which.

DETAILED DESCRIPTION

Figure 1:
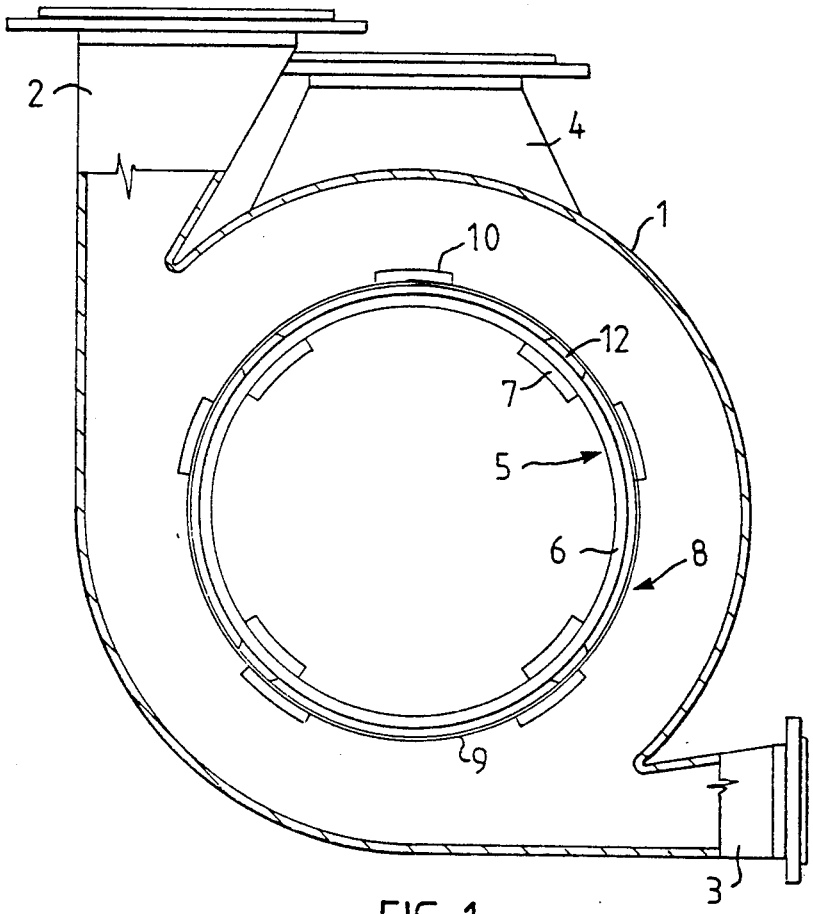
FIG. 1 is a top, elevational, cross-sectional view of a screening apparatus in accordance with the present invention.
Figure 2:
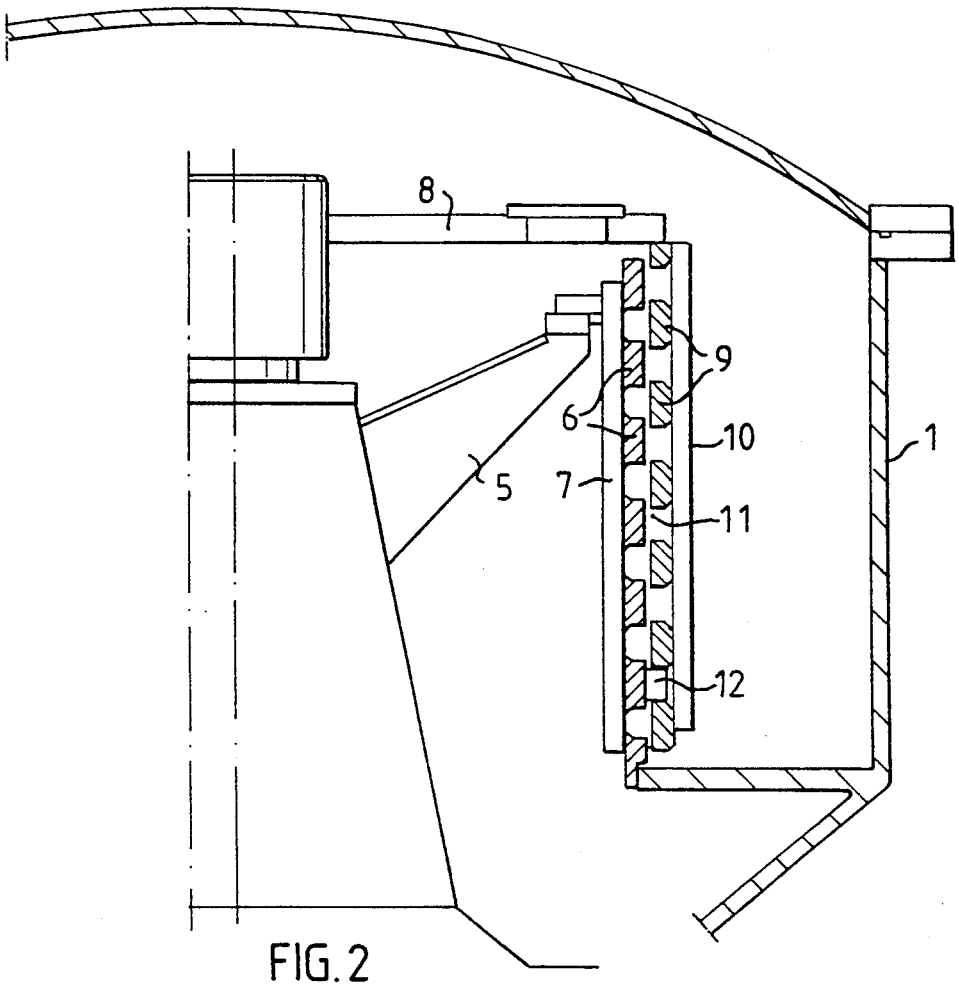
FIG. 2 is a side, elevational, partially sectional view of a portion of the apparatus shown in FIG. 1.
Figure 3:
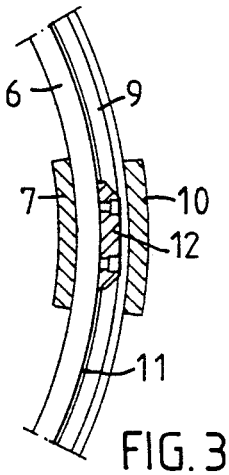
FIG. 3 is an enlarged, sectional view of a portion of the apparatus of the present invention shown in FIG. 1.

Referring to the Figures, in which like numerals refer to like portions thereof, the screening device shown in FIG. 1 includes a cylindrical housing 1 with an inject inlet 2, a reject outlet 3, and an accept outlet 4. A stator 5 is located in the housing 1, and consists of a number of annular stator elements 6 spaced radially equally from a center line, but in a mutual axially spaced relationship. The cylindrical outer surfaces of elements 6 are located on the same radius, and these elements are held in place by a number of axially arranged stator holders 7.

A rotor 8 is located outside the stator 5, and comprises a number of annular rotor elements 9, which are attached to rotor holders 10, arranged axially on the rotor 8. The rotor elements 9 have cylindrical inner surfaces, and are located directly in front of the spaces between the stator elements 6 and to a certain extent overlap the outer surfaces of the stator elements 6, so that a number of axial gaps 11 are formed between the stator and the rotor elements 6 and 9, respectively. The size of these gaps is determined by the radial distance between the outer and inner surfaces of the elements 6 and 9, respectively. The gap width should be from about 1 to 12 mm, and preferably from about 3 to 6 mm.

The axial length of the gaps, which is determined by the overlapping of the rotor elements 9 over the stator elements 6, should be from about 1 to 15 mm, and preferably from about 4 to 12 mm.

The inject inlet 2 preferably has a spiral shape, and is directed so that the inject is guided tangentially into the housing 1 without meeting the rotor 8 directly.

On every stator element 6, a number of cleansing members 12, preferably 2 to 4 such members, are arranged, and are formed as shoulders extending into the spaces between the rotor elements 9. The shoulders 12 should be limited in length in the circumferential direction, and preferably have a bevelled front and rear edge.

Figure 4:
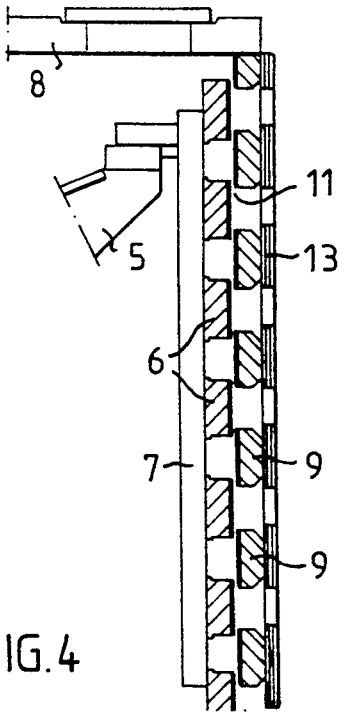
FIG. 4 is a side, elevational, partial sectional view of another embodiment of the apparatus of the present invention.

The embodiment shown in FIG. 4 differs from the embodiment described above solely in that the rotor holders 10 have been replaced by a perforated cylindrical plate 13 to which the rotor elements 9 are attached.

When mounting this device, the stator 5 with stator elements 6 is inserted as one unit. Thereafter, the rotor 8 with rotor elements 9 is inserted as one unit. Finally, the cleansing members 12 are mounted on the stator elements 6 in the spaces between the rotor elements 9.

Screening of the pulp suspension is carried out from the outside inward in a manner such that the pulp suspension is supplied tangentially to the cylindrical housing 1 through the inlet 2. Large and heavy impurities are thus prevented by centrifugal force from entering into the gaps 11 and, instead, are moved to the reject outlet 3. The pulp suspension flows into the spaces between the rotor elements 9, and is there divided into accept and reject portions. The accept portion is discharged from the space inside the gaps, through the accept outlet 4, and the reject portion is removed from the housing 1 through the reject outlet 3. The rotor holders 10 can also have a favorable effect on the separation process by throwing coarse and heavy particles outward from the gaps. In the embodiment equipped with a perforated plate 13, as a holder for the rotor elements 9, the perforations therein are utilized for coarse separation.

The cleansing members 12 have the object of partially preventing fibrous material from adhering to the gaps, and partially bringing bout pulsations in the suspension adjacent the gaps, to thereby promote the screening process.

The screening device according to this invention has a simple and robust structure, and one in which the screening elements can be exchanged quickly and easily. The screen has a high capacity and efficiency, and can advantageously be placed, for example, directly after a blow tank.

Figure 5:
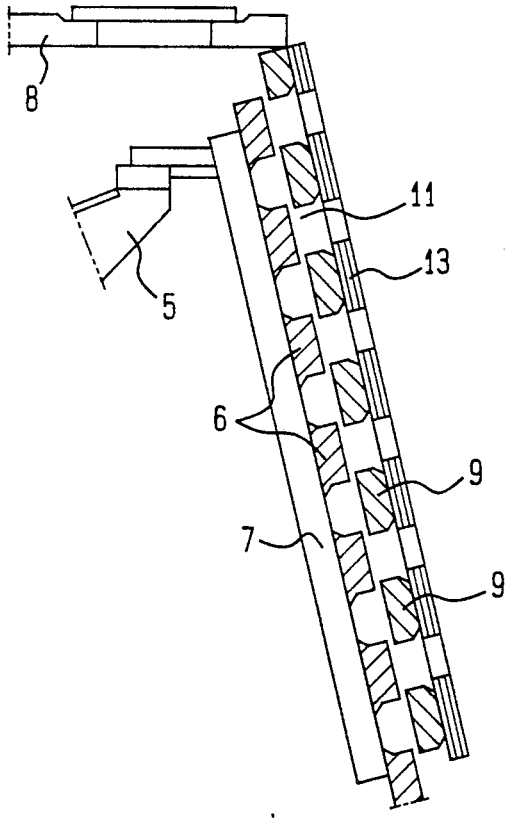
FIG. 5 is a side, elevational, partially sectional view of another embodiment of the apparatus of the present invention.

The axis of rotation of the screen is preferably vertical, or at least substantially vertical. Alternatively, the screen may have an inclined axis of rotation, which can even be horizontal. The surfaces defining the gaps, i.e., the outer surfaces of the stator elements 6 and the inner surfaces of the rotor elements 9, are preferably cylindrical, but may also be conical (as shown in FIG. 5). These surfaces are smooth or can be provided with unevennesses in the gaps, in order to additionally ensure that no material adheres thereto.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. Apparatus for screening a pulp suspension comprising a housing including an inlet for said pulp suspension, screening means for screening said pulp suspension, a reject outlet for removal of a portion of said pulp suspension which does not pass through said screening means, and an accept outlet for removal of a portion of said pulp suspension which does pass through said screening means, said screening means comprising a stator rigidly mounted within said housing, a rotor rotatably mounted within said housing radially outward from said stator, said stator including a plurality of annular stator elements axially spaced along said stator whereby said plurality of stator elements alternate with a plurality of stator spaces therebetween, and said rotor including a plurality of annular rotor elements axially spaced along said rotor, whereby said plurality of rotor elements alternate with a plurality of rotor spaces therebetween, said plurality of rotor elements being axially spaced at locations corresponding to said plurality of stator spaces, thereby forming axial gaps between said plurality of stator elements and said plurality of rotor elements.

2. The apparatus of claim 1 wherein said plurality of stator spaces each comprises a predetermined axial stator space length.

3. The apparatus of claim 2 wherein said plurality of rotor elements each comprises a predetermined axial rotor element length, said predetermined axial rotor element length being greater than said predetermined axial stator space length, whereby said plurality of rotor elements overlaps said plurality of stator spaces.

4. The apparatus of claim 1 wherein said plurality of annular stator elements includes an outer surface, and said plurality of annular rotor elements includes an inner surface, and both said outer surface of said plurality of annular stator elements and said inner surface of said plurality of annular rotor elements are cylindrical.

5. The apparatus of claim 1 wherein said plurality of annular stator elements includes an outer surface and said plurality of annular rotor elements includes an inner surface, and both said outer surface of said plurality of annular stator elements and said inner surface of said plurality of annular rotor elements are conical.

6. The apparatus of claim 1 wherein said stator includes a plurality of axially extending stator holding means for mounting said plurality of annular stator elements.

7. The apparatus of claim 1 wherein said rotor includes a plurality of axially extending rotor holding means for mounting said plurality of annular rotor elements.

8. The apparatus of claim 1 wherein said rotor includes axially extending perforated plate means for mounting said plurality of annular rotor elements.

9. The apparatus of claim 3 including cleaning means mounted on at least one of said plurality of annular stator elements and extending into at least one of said corresponding plurality of rotor spaces.

10. The apparatus of claim 9 wherein said cleaning means comprises a plurality of cleaning elements mounted on said plurality of annular stator elements and extending into said corresponding plurality of rotor spaces.

* * * * *

UNITED STATES PATENT AND TRADEMARK OFFICE

CERTIFICATE OF CORRECTION

PATENT NO. : 5,271,503

DATED : December 21, 1993

INVENTOR(S) : Alf I. Lindström

It is certified that error appears in the above-identified patent and that said Letters Patent is hereby corrected as shown below:

Title page, item

[22] Delete "25" and insert therefor --16--.

Signed and Sealed this

Seventeenth Day of May, 1994

Bruce Lehman

*Attest:*

BRUCE LEHMAN

*Attesting Officer*

*Commissioner of Patents and Trademarks*